United States Patent [19]

Maus

[11] Patent Number: 4,900,896

[45] Date of Patent: Feb. 13, 1990

[54] CONTINUOUS FLOW WATER HEATER WITH MAGNETICALLY-ACTUATED FLOW SWITCH

[76] Inventor: Daryl D. Maus, 3550 Smuggler Cir., Boulder, Colo. 80303

[21] Appl. No.: 72,761

[22] Filed: Jul. 13, 1987

Related U.S. Application Data

[63] Continuation-in-part of Ser. No. 834,754, Feb. 28, 1986, abandoned, which is a continuation-in-part of Ser. No. 649,467, Sep. 12, 1984, abandoned.

[51] Int. Cl.[4] ..... H04B 1/02; H05B 3/82; F24H 1/10; H01H 35/34

[52] U.S. Cl. ..... 219/309; 200/819 M; 219/306; 219/312; 219/314

[58] Field of Search ..... 219/296, 306, 307–309; 200/81.9 M, 81.9 R

[56] References Cited

U.S. PATENT DOCUMENTS

| | | | |
|---|---|---|---|
| 1,340,668 | 5/1920 | Papini | 219/332 |
| 1,533,491 | 9/1925 | Werner . | |
| 1,704,627 | 3/1929 | Osterheld | 200/81.9 R X |
| 2,032,125 | 2/1936 | Gazelle . | |
| 2,066,190 | 12/1936 | Swars . | |
| 2,376,537 | 5/1945 | Hall . | |
| 2,413,611 | 12/1946 | Draffin . | |
| 2,576,603 | 11/1951 | Hines et al. . | |
| 2,661,409 | 12/1953 | Lorenzetti | 200/81.9 R |
| 2,742,560 | 4/1956 | Liebhafsky . | |
| 2,843,717 | 7/1958 | Tracy | 219/309 |
| 2,957,069 | 10/1960 | Dammond | 219/306 |
| 3,560,706 | 2/1971 | Fonseca | 200/81.9 R X |
| 3,611,220 | 10/1971 | Hoffman | 200/81.9 M |
| 4,085,305 | 4/1978 | Dietz | 200/81.9 R |
| 4,185,187 | 1/1980 | Rogers | 219/309 X |
| 4,288,685 | 9/1981 | Tommaso | 200/81.9 R X |
| 4,358,665 | 11/1982 | Owen . | |
| 4,484,062 | 11/1984 | Estevez . | |

FOREIGN PATENT DOCUMENTS

| | | |
|---|---|---|
| 609199 | 2/1935 | Fed. Rep. of Germany . |
| 518425 | 3/1955 | Italy . |
| 521586 | 3/1955 | Italy . |
| 241364 | 7/1946 | Switzerland . |

*Primary Examiner*—Anthony Bartis

*Attorney, Agent, or Firm*—Don J. Flickinger; Jordan M. Meschkow; Lowell W. Gresham

[57] ABSTRACT

A continuous flow water heater has a sealed chamber containing an electrical heating element and a diaphragm having an orifice through which water must flow upon a demand for hot water. The center of the diaphragm translates axially in response to the water flow and moves an internal magnet which influences an external magnet to throw a flow switch. A heat sink made from a material exhibiting high thermal conductivity extends from within the sealed chamber to a position in heat exchanging relationship with a thermostat, the contacts of which are closed unless the water exceeds a set value. The flow switch and thermostat are in series with a source of electricity and the heating element such that the heating element is only energized if there is water flow through the heater and if the exiting water does not exceed a selected temperature. The sealed chamber is contained within a housing made of heat-resistant plastic. A plurality of opposed pairs of longitudinally extending grooves are formed in the housing, and a mounting bracket is provided for detachably snapping into one of the pairs of grooves to allow the heater to be mounted in a variety of different orientations.

8 Claims, 2 Drawing Sheets

FIG. 1
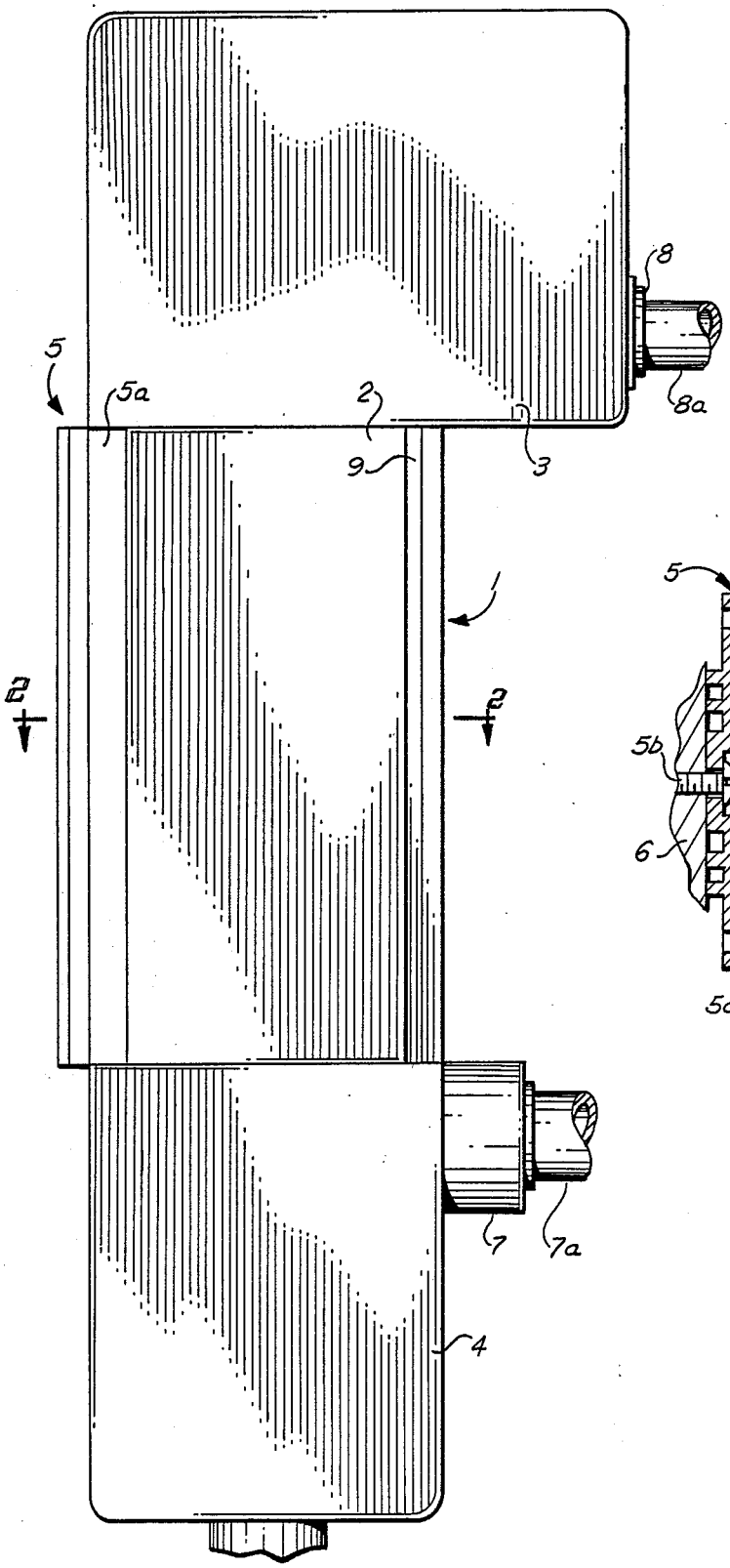
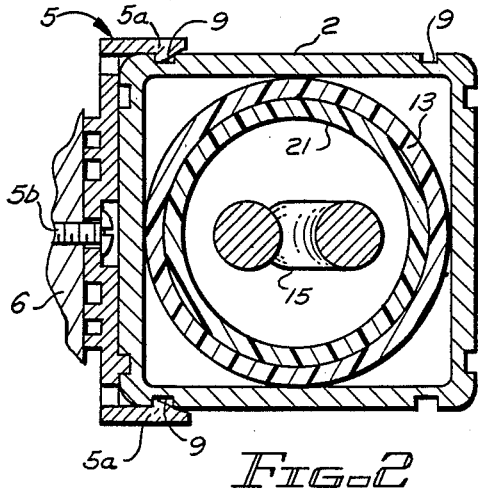
FIG. 2

CONTINUOUS FLOW WATER HEATER WITH MAGNETICALLY-ACTUATED FLOW SWITCH

CROSS-REFERENCE TO RELATED APPLICATIONS

This application is a continuation-in-part of my copending patent application Ser. No. 834,754, filed Feb. 28, 1986, entitled WATER HEATING SYSTEM, now abandoned and which is, in turn, a continuation-in-part of my patent application Ser. No. 649,467, filed Sept. 12, 1984, and also entitled WATER HEATING SYSTEM, now abandoned.

FIELD OF THE INVENTION

This invention relates to improved apparatus for heating water, particularly for use as a residential or commercial water heater. More specifically, this invention relates to electrically energized continuous flow water heaters with improved temperature regulation and electrical heating element control systems.

BACKGROUND OF THE INVENTION

There are two types of water heaters in widespread use; viz.: the instantaneous water heater and the batch water heater. The first category of heaters, also known as continuous flow heaters, is exemplified by the water heaters disclosed in U.S. Pat. Nos. 4,424,767 and 4,282,421. They typically include a small vessel or pipe with no substantial storage capacity and a high capacity heat source activated by the flow of water and/or a thermostat. Continuous flow water heaters provide hot water only on demand, thus eliminating standby losses.

However, the known prior art continuous flow water heaters are significantly limited in flow deliver capacity by the heat input available. The heating rate capacity of electric heaters is determined by the available wattage of the elements (five to seven kilowatts typically) and by the available electrical service (typically thirty amperes maximum). These factors restrict the available hot water temperatures to less than satisfactory levels for the continuous flow requirements of most users. Another disadvantage of the prior art continuous flow water heaters is their inability to accurately regulate the output temperature as flow rates fluctuate without the use of expensive and complex controls. Still another disadvantage of the prior art water heaters of this class is that the heating element is usually built-in and is therefore not replaceable. As a result, failure of the heating element alone necessitates replacement of the entire heater unit. The present invention addresses and solves these and other problems characteristic of the prior art continuous flow water heaters.

It would be highly advantageous, therefore, to overcome the deficiencies of the existing continuous flow water heaters presently available.

OBJECTS OF THE INVENTION

Accordingly, it is a broad object of this invention to provide an improved water heating system.

It is another object of this invention to provide a water heater with reduced standby heat loss.

With respect to electrically energized continuous flow water heaters, additional objects of this invention include:

(a) regulation of the temperature of water issued from such a continuous flow heater with a low cost, high reliability control;

(b) elimination of the possibility of "dry firing", i.e., the operation of an electric heating element in air;

(c) lowering the cost to manufacture a continuous flow water heater while providing improved recovery performance;

(d) provision of a continuous flow heater with an individually replaceable heating element;

(e) provision of a continuous flow water heater with a sensitive low differential flow switching device of reliable mechanical design and low cost;

(f) the provision of a continuous flow water heater that is easy to assemble and can be made primarily of corrosion-resistant plastic materials;

(g) the provision of a continuous flow water heater with magnetically coupled switching that is not position sensitive such that the heater may be mounted horizontally, vertically or in any other position;

(h) the provision of a continuous flow heater with a long life, high contact force flow control switch which is coupled magnetically to a flow sensitive diaphragm mechanism.

(i) the provision of a continuous flow heater that can accommodate any length, and hence any capacity, standard electric heating element;

(j) the provision of continuous flow heaters of different lengths that utilize a universally applicable snap action mounting bracket; and (k) the provision of a continuous flow water heater that connects to standard pipework without special fittings or tools.

SUMMARY OF THE INVENTION

In a continuous flow water heater embodiment, the water heater includes an exterior housing containing a sealed chamber defined by a central tube and top and bottom fittings, at least the top fitting being made from a material (such as heat resistant plastic) through which magnetic flux will pass. The heater is connected in a water circuit via a cold water inlet to the sealed chamber and a hot water outlet from the sealed chamber, the sealed chamber also containing an electrical heating element. A switch assembly situated outboard the sealed chamber in the region of the top fitting includes a flow switch having contacts actuable in response to travel of an actuator which carries a first magnet and, in series with the flow switch, a thermostat having contacts actuable in response to sensed output water temperature. A diaphragm extends across the sealed chamber and flexes coaxially therein in response to water pressure differential as the water flows through an orifice in the diaphragm to the outlet, no such pressure differential therefore being present unless water is being delivered from the outlet. The diaphragm, when it flexes in response to water flow, displaces a second magnet which is flux-coupled to the first magnet; therefore, the flow switch is only actuated under flow conditions such that the heating element cannot "dry fire". The temperature of the exiting water is regulated by the thermostat which independently cuts off energization of the heating element when the water temperature exceeds a predetermined maximum value.

DESCRIPTION OF THE DRAWING

The subject matter of the invention is particularly pointed out and distinctly claimed in the concluding portion of the specification. The invention, however, both as to organization and method of operation, may best be understood by reference to the following description taken in conjunction with the subjoined claims and the accompanying drawing of which:

FIG. 1 is an exterior side view of a continuous flow water heater embodiment of this invention illustrating the manner in which it may be attached to a wall surface;

FIG. 2 is a cross sectional view of the continuous flow water heater taken along the lines 2—2 of FIG. 1 and particularly showing the manner in which the heater housing is detachably coupled to a mounting bracket;

DETAILED DESCRIPTION OF THE INVENTION

Figure 3:
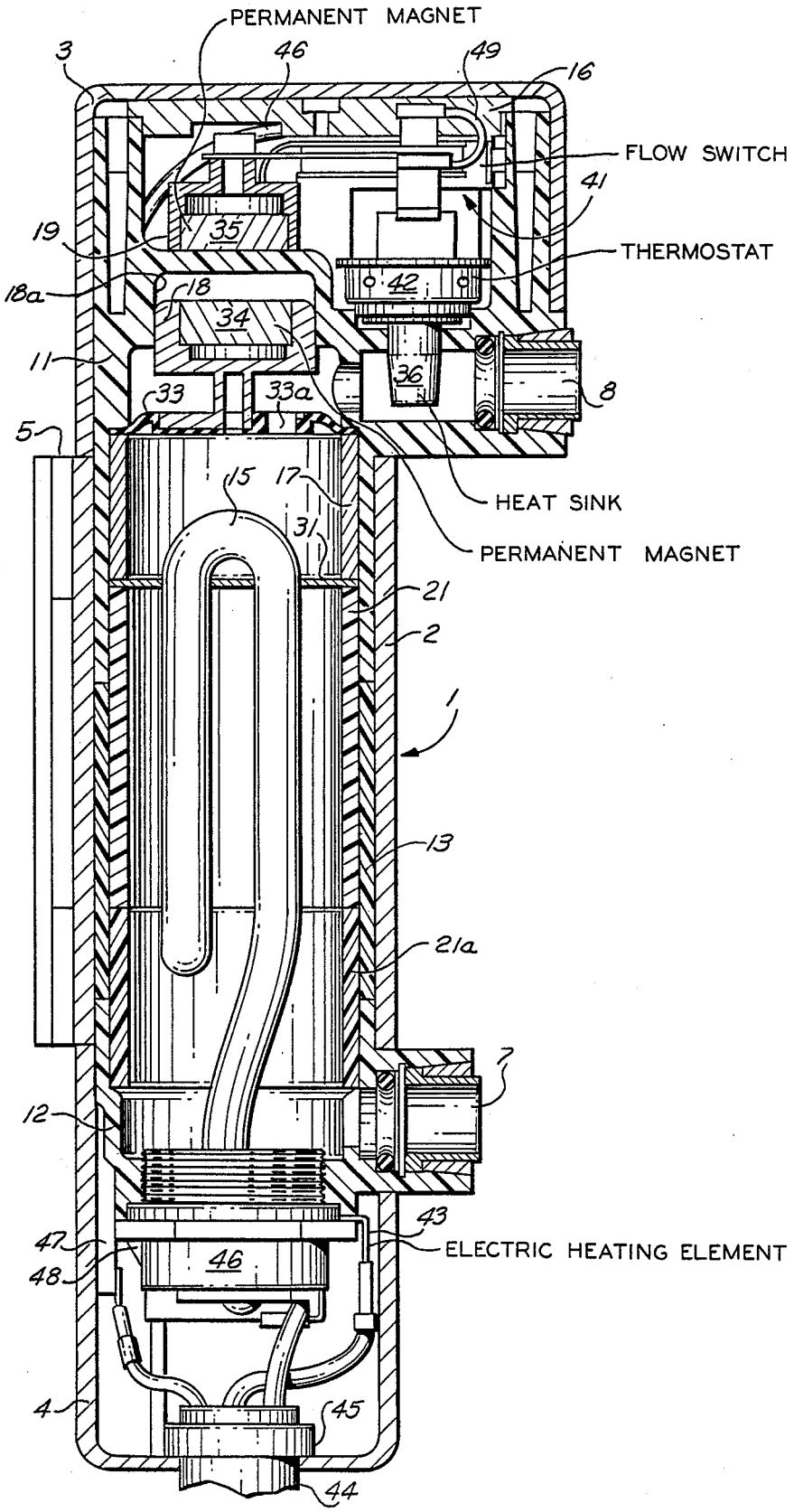
FIG. 3 is a view of the continuous flow water heater in which the outer housing section facing outwardly had been broken away to reveal the internal structure of the heater.

Referring first to FIG. 1, there is shown a continuous flow water heater according to the present invention. The heater, which can be mounted in any orientation, is illustratively fixed to a wall 6 in a vertical position by a mounting bracket 5. The exterior housing of the heater 1 includes a central cover extrusion 2, a top end cover 3 and a bottom end cover 4. Referring also to FIG. 2, the exterior of the central cover extrusion 2 is provided with longitudinal grooves 9 situated proximate and to each side of each corner of the central cover extrusion. Wing detents 5*a* of the mounting bracket 5 are dimensioned and configured to detachably snap into an opposing pair of the grooves 9 of the cover extrusion 2 such that the heater 1 may be coupled to the mounting bracket 5 in several different orientations. The mounting bracket 5 is affixed to the wall by a screw 5*b* in a convenient position, such as beneath a sink which has a hot water faucet to be fed by the heater 1, and the heater is then snapped into position. A cold water inlet fitting 7 is conventionally connected to a cold water supply pipe 7*a*; similarly, a hot water outlet fitting 8 is conventionally connected to a hot water delivery pipe 8*a* for transfer of the heated water to one or more user devices.

Referring now to FIG. 3 which shows the internal structure of the continuous flow water heater 1, a bottom fitting 12, a segmented central tube 21, 21*a* and a top fitting 11 (all of which may be fabricated from a plastic of appropriate characteristics) collectively define a sealed chamber for the controlled heating of water in applications for which a continuous plentiful flow of hot water is called for. A central fitting 13 surrounds central tube 21, 21*a*, filling in the space between top fitting 11 and bottom fitting 12. The dimensions of the chamber may be selected to accommodate any length heating element 15 by adjusting the length of the central tube 21 which may be solvent welded at its ends to fittings 11 and 12. The central cover extrusion may accordingly be conformed in length as required and forms an attractive outer housing assembly in conjunction with the end covers 3 and 4, the housing assembly also serving to isolate all moving and electrical parts from the outside.

Water passing through the heater is selectively heated by an electrically energized heating element 15 which is of standard construction and is provided with a threaded fitting at its base in order that it can be removed from the bottom fitting 12 and replaced if required. A grounding ring 43 is in direct contact with the heating element 15 and provides electrical grounding through a cord set 44 which enters through the bottom end cover 4 and furnishes electrical power to the heater.

The flow of electricity to the heating element 15 is controlled by a flow switch 41 and a thermostat 42 which are connected in series. Thus, the flow switch 41 and the thermostat 42 must have their contacts closed concurrently before electricity is delivered to the heating element 15. The thermostat 42 accurately senses the temperature of the discharged hot water because it is in direct thermal contact with a heat sink 36 which is sealed through the wall of the top fitting 11 and is in direct contact with the exiting hot water. The heat sink 36 may be made of copper, brass or any other material exhibiting high thermal conductivity so that it responds rapidly to changes in the temperature of the discharge stream of hot water.

The flow switch 41 is positioned above the thermostat 42 and is held in place by a bridge 16 which is, in turn, held in place by the top end cover 3. Preferably, the flow switch 41 is a momentary contact, snap action type characterized by high contact force and fast switching times. Secured to the flow switch 41 and functioning as an actuator for its is an external magnet holder 19 having an external magnet 35 situated inside. In this position, the external magnet 35 is capable of being repelled by an appropriately polarized internal magnet 34 and is therefore responsive to the motion of an internal magnet holder 18 which carries the internal magnet.

Those skilled in the art will appreciate that the repulsive force between the magnets 34 and 35 depends upon their physical proximity to one another. The internal magnet holder 18 moves in response to the flexing of a diaphragm 33 which senses and responds to the pressure differential across it created by the flow of water through the heater and through a diaphragm orifice 33*a*. The internal magnet holder 18 is piston shaped and moves inside a cylinder 18*a* formed in the top fitting 11 which, as previously noted, is plastic and therefore passes magnetic flux. The cylinder 18*a* is closely sized to the outer diameter of the internal magnet holder 18 to just permit coaxial movement of the holder in the cylinder. This feature restricts the flow of water around the internal magnet holder 18, thereby dampening its motion and also preventing the migration of mineral sediments to the top of internal magnet 34.

The diaphragm 33 is held in place by a spacer 17 which is secured by the central tube 21 when it is solvent welded into the top fitting 11. The spacer 17 also limits the motion of the diaphragm 33 to prevent its coming into contact with the heating element 15 and also maintaining the internal magnet holder 18 securely positioned in its well in the top fitting 11. Situated between the central tube 21 and the spacer 17 is an apertured plate 31 which serves to maintain the heating element 15 in the center of the tube and prevent its contact with any of the other components of the heater.

Individual examples of the diaphragm 33 may be fabricated with various size orifices 33*a* to facilitate the straightforward fabrication of continuous flow heaters that switch on and off at different flow rates as may be required by the use of different capacity heating elements 15.

When hot water is demanded by a utilization device, cold water enters the inlet 7, passes by the heating element 15 and is discharged through the outlet 8. The water, in passing through the metering orifice 33*a*, exerts an axial force on the diaphragm 33 whose center moves upwardly to displace the coaxially aligned internal magnet holder 18 (and the internal magnet 34) correspondingly upwardly to repel the external magnet 35 and thus cause the coaxially aligned external magnet holder 19 to move against and actuate the flow switch 41. Therefore, at a flow rate determined by the size of the orifice 33*a*, sufficient force is generated by the water pressure on the diaphragm 33 to cause the flow switch 41 to close, thus energizing the element 15 (if the contacts of the thermostat 42 are also closed) and heating the water flowing through the heater. This feature insures that the heating element 15 cannot be energized under "dry" conditions, i.e., without any water surrounding the heating element. As a result, the heater 1 is not only responsive to the demand for hot water, but is also safer and longer lasting.

As previously mentioned, the thermostat 42 is in thermal equilibrium, via heat sink 36, with the heated water exiting the hot water outlet 8. If the water temperature should exceed a predetermined maximum, the contacts of the thermostat 42 open to de-energize the heating element 15 until the exiting water drops below the predetermined temperature. This feature insures that the temperature of the hot water supplied by the heater is not only within a desired and predetermined range, but also that it does not exceed a safe maximum temperature.

Thus, while the principles of the invention have now been made clear in an illustrative embodiment, there will be immediately obvious to those skilled in the art many modifications of structure, arrangements, proportions, the elements, materials, and components, used in the practice of the invention which are particularly adapted for specific environments and operating requirements without departing from those principles.

What is claimed is:

1. A continuous flow water heater comprising:

(a) an exterior housing;

(b) a sealed chamber contained within said housing and defining a water flow path, said sealed chamber being defined by:

(1) a central tube;

(2) a top fitting connected to one end of said central tube; and (3) a bottom fitting connected to the other end of said central tube;

said sealed chamber further including:

(4) a cold water inlet fitting adapted to be connected to a pipe coupled to a source of cold water under pressure; and (5) a hot water outlet fitting adapted to be connected to a pipe coupled to a hot water utilization device;

(c) an electrical heating element disposed in said sealed chamber;

(d) switch means situated outboard said sealed chamber and within said exterior housing, said switch means including:

(1) an actuator;

(2) a flow switch having contacts actuable in response to travel of said actuator;

(3) a thermostat having contacts actuable in response to said thermostat sensing a temperature in excess of a predetermined value;

(e) electrical conductor means connecting said flow switch, said thermostat and said heating element in series and to an external source of energy such that said heating element is only energized when said contacts of said flow switch and said contacts of said thermostat are both closed;

(f) a diaphragm situated within and extending across said sealed chamber and oriented for limited translation with respect to the longitudinal axis of said sealed chamber in response to water pressure bearing on said diaphragm as water flows through said sealed chamber, said diaphragm including:

(1) an orifice through which water must pass as it flows through said sealed chamber;

(g) switch actuating means coupled to said diaphragm for moving said actuator to actuate said flow switch in response to axial translation of said diaphragm resulting from water flow through said sealed chamber; and (h) a heat sink made from a material exhibiting high thermal conductivity and extending from within said sealed chamber proximate said hot water outlet fitting to a position in heat exchanging relationship with said thermostat whereby said thermostat senses and is responsive to the temperature of hot water passing through said hot water outlet fitting such that said contacts of said thermostat open when the temperature of the hot water is sensed to exceed said predetermined value.

2. The continuous flow water heater of claim 1 in which said switch actuating means comprises:

(a) an internal magnet in said sealed chamber coupled to said diaphragm for movement therewith; and (b) an external magnet outside of said chamber coupled to said actuator;

and in which:

(c) said top fitting is made from a material through which magnetic flux will pass, and said internal magnet and said external magnet are flux-linked through said top fitting to cause movement of said actuator in response to coaxial translation of said diaphragm.

3. The continuous flow water heater of claim 2 in which said electrical heating element is provided with a threaded base screwed into said bottom fitting.

4. The continuous flow water heater of claim 3 in which:

(a) said internal magnet is carried by an internal magnet holder coupled to said diaphragm;

(b) said external magnet is carried by an external magnet holder, said external magnet holder functioning as said actuator; and (c) said internal magnet holder, said external magnet holder and said diaphragm are coaxially aligned.

5. The continuous flow water heater of claim 4 in which said central tube, said top fitting and said bottom fitting are each fabricated from a heat resistant plastic.

6. A continuous flow water heater comprising:

(a) an exterior housing;

(b) a sealed chamber contained within said housing and defining a flow path, said sealed chamber being defined by:

(1) a central tube;

(2) a top fitting connected to one end of said central tube and made from a material through which magnetic flux will pass and having a cylinder formed therein; and (3) a bottom fitting connected to the other end of said central tube;

said sealed chamber further including:

(4) a cold water inlet fitting adapted to be connected to a pipe coupled to a source of cold water under pressure; and (5) a hot water outlet fitting adapted to be connected to a pipe coupled to a hot water utilization device;

(c) an electrical heating element disposed in said chamber;

(d) switch means situated outboard said sealed chamber and within said exterior housing, said switch means including:

(1) an actuator;

(2) a flow switch having contacts actuable in response to travel of said actuator;

(3) a thermostat having contacts actuable in response to said thermostat sensing a temperature in excess of a predetermined value;

(e) electrical conductor means connecting said flow switch, said thermostat, and said heating element in series and to an external source of electricity such that said heating element is only energized when said contacts of said flow switch and said contacts of said thermostat are both closed;

(f) a diaphragm situated within and extending across said sealed chamber and oriented for limited translation with respect to the longitudinal axis of said sealed chamber in response to water pressure bearing on said diaphragm as water flows through said sealed chamber, said diaphragm including an orifice through which water must pass as it flows through said sealed chamber;

(g) switch activating means coupled to said diaphragm and said actuator for moving said actuator to actuate said flow switch in response to axial translation of said diaphragm resulting from water flow through said sealed chamber, said switch actuating means including (1) a piston-shaped internal magnet holder mounted for reciprocation within said cylinder formed in said top fitting, said magnet holder being coupled to said diaphragm for movement therewith;

(2) an internal magnet mounted in said internal magnet holder;

(3) a piston-shaped external magnet holder mounted outside of said sealed chamber and coupled to said actuator; and (4) an external magnet mounted in said external magnet holder; and in which (5) said internal magnet and said external magnet are flux-linked through said top fitting to cause movement of said actuator in response to axial translation of said diaphragm; and (h) a heat sink extending from within said sealed chamber proximate said hot water outlet fitting to a position in heat exchanging relationship with said thermostat whereby said thermostat senses and is responsive to the temperature of hot water passing through said hot water outlet fitting such that said contacts of said thermostat open when the temperature of the hot water is sensed to exceed said predetermined value.

7. The continuous flow water heater of claim 6 wherein said cylinder in said top fitting is closely sized to the outer diameter of said internal magnet holder to restrict the flow of water around said magnet holder, thereby dampening the motion of said internal magnet holder and preventing the migration of mineral sediments to the top of said internal magnet.

8. A continuous flow water heater comprising:

(a) an exterior housing including (1) a top end cover;

(2) a bottom end cover;

(3) a central cover extrusion captured between said top end cover and said bottom end cover, said central cover extrusion including a plurality of corners; and (4) a plurality of longitudinal grooves formed in said central cover extrusion, one groove being formed proximate and to each side of each corner of said central extrusion, said grooves being arranged in opposing pairs;

(b) a mounting bracket having a pair of opposed wing detents dimensioned and configured to detachably snap into an opposing pair of said grooves such that said heater may be coupled to said mounting bracket in several different orientations;

(c) a sealed chamber contained within said housing and defining a water flow path, said sealed chamber being defined by:

(1) a central tube mounted inside said central cover extrusion;

(2) a top fitting mounted inside said top end cover; and (3) a bottom fitting mounted inside said bottom end cover;

said sealed chamber further including:

(4) a cold water inlet fitting adapted to be connected to a pipe coupled to a source of cold water under pressure; and (5) a hot water outlet fitting adapted to be connected to a pipe coupled to a hot water utilization device;

(c) an electrical heating element disposed in said chamber;

(d) switch means situated outboard said sealed chamber and within said top fitting of said housing, said switch means including:

(1) an actuator;

(2) a flow switch having contacts actuable in response to travel of said actuator;

(3) a thermostat having contacts actuable in response to said thermostat sensing a temperature in excess of a predetermined value;

(e) electrical conductor means connecting said flow switch, said thermostat, and said heating element in series and to an external source of electricity such that said heating element is only energized when said contacts of said flow switch and said contacts of said thermostat are both closed;

(f) a diaphragm situated within and extending across said sealed chamber and oriented for limited axial translation with respect to the longitudinal axis of said sealed chamber in response to water pressure bearing on said diaphragm as water flows through said sealed chamber, said diaphragm including an orifice through which water must pass as it flows through said sealed chamber;

(g) switch activating means coupled to said diaphragm and said actuator and adapted to move said actuator to actuate said flow switch in response to axial translation of said diaphragm resulting from water flow through said sealed chamber; and (h) a heat sink extending from within said sealed chamber proximate said hot water outlet fitting to a position in heat exchanging relationship with said thermostat whereby said thermostat senses and is responsive to the temperature of hot water passing through said hot water outlet fitting such that said contacts of said thermostat open when the temperature of the hot water is sensed to exceed said predetermined value.

* * * * *